US011401781B2

(12) United States Patent
Kent et al.

(10) Patent No.: US 11,401,781 B2
(45) Date of Patent: Aug. 2, 2022

(54) METHOD AND STIMULATION SLEEVE FOR WELL COMPLETION IN A SUBTERRANEAN WELLBORE

(71) Applicant: Superstage AS, Indre Arna (NO)

(72) Inventors: Anthony Kent, Houston, TX (US); Jan Tore Tveranger, Garnes (NO)

(73) Assignee: Superstage AS, Indre Arna (NO)

( * ) Notice: Subject to any disclaimer, the term of this patent is extended or adjusted under 35 U.S.C. 154(b) by 0 days.

(21) Appl. No.: 16/761,697

(22) PCT Filed: Nov. 6, 2018

(86) PCT No.: PCT/NO2018/050264
§ 371 (c)(1),
(2) Date: May 5, 2020

(87) PCT Pub. No.: WO2019/088849
PCT Pub. Date: May 9, 2019

(65) Prior Publication Data

US 2021/0017837 A1 Jan. 21, 2021

(30) Foreign Application Priority Data

Nov. 6, 2017 (NO) ..... 20171752

(51) Int. Cl.
*E21B 34/14* (2006.01)
*E21B 34/10* (2006.01)
(Continued)

(52) U.S. Cl.
CPC ..... *E21B 34/108* (2013.01); *E21B 34/063* (2013.01); *E21B 34/142* (2020.05);
(Continued)

(58) Field of Classification Search
CPC ..... E21B 34/125; E21B 34/14; E21B 34/142
See application file for complete search history.

(56) References Cited

U.S. PATENT DOCUMENTS 8,418,769 B2 * 4/2013 Fay ..... E21B 34/14 166/373
8,668,012 B2 * 3/2014 Porter ..... E21B 43/14 166/318

(Continued)

FOREIGN PATENT DOCUMENTS

| | | |
|---|---|---|
| WO | 2014/055332 | 4/2014 |
| WO | 2015/088524 | 6/2015 |
| WO | 2015/169676 | 11/2015 |

*Primary Examiner* — Kenneth L Thompson
(74) *Attorney, Agent, or Firm* — Phillip Black; Dossey & Jones, PLLC

(57) ABSTRACT

Stimulation sleeve (1) for well intervention in a subterranean wellbore, comprising: a housing (10) having a through channel (11) with a first end (11*a*) and a second end (11*b*), and one or more flow ports (14), and a sliding sleeve (13) disposed axially movable within the housing (10) to open or close said flow ports (14). Said sliding sleeve (13) is equipped with at least a first obturator seat (15) for receipt of a obturator (17) to partially or fully close fluid communication in the through channel (11) of the housing (10), and a time delay mechanism (20) to allow the sliding sleeve (13) to axially travel in the housing (10) at a predetermined speed to open or close said flow ports (14). The invention also discloses a method for well completion in a subterranean wellbore using a sliding sleeve (1).

28 Claims, 16 Drawing Sheets

(51) Int. Cl.
*E21B 34/06* (2006.01)
*E21B 43/14* (2006.01)
*E21B 43/26* (2006.01)

(52) U.S. Cl.
CPC ..... *E21B 43/14* (2013.01); *E21B 43/26* (2013.01); *E21B 2200/04* (2020.05); *E21B 2200/06* (2020.05)

(56) References Cited

U.S. PATENT DOCUMENTS

| | | | | |
|---|---|---|---|---|
| 8,931,565 | B2 * | 1/2015 | Desranleau | E21B 34/14 166/373 |
| 8,991,509 | B2 * | 3/2015 | Merron | E21B 43/26 166/386 |
| 9,016,379 | B2 * | 4/2015 | Xu | E21B 34/14 166/308.1 |
| 9,353,599 | B2 * | 5/2016 | Watson | E21B 43/26 |
| 10,900,323 | B2 * | 1/2021 | Kent | E21B 34/108 |
| 2004/0163820 | A1 | 8/2004 | Company | |
| 2012/0234545 | A1 | 9/2012 | Xu | |
| 2013/0081817 | A1 | 3/2013 | Matzel et al. | |
| 2013/0233535 | A1 | 9/2013 | Halliburton | |
| 2014/0000909 | A1 | 1/2014 | Inc. | |
| 2014/0083680 | A1 | 3/2014 | Brekke | |
| 2017/0241238 | A1 | 8/2017 | Weatherford | |
| 2018/0119517 | A1 | 5/2018 | Hered et al. | |

* cited by examiner

METHOD AND STIMULATION SLEEVE FOR WELL COMPLETION IN A SUBTERRANEAN WELLBORE

FIELD OF THE INVENTION

The present invention relates to a method and a stimulation sleeve for well completions in a subterranean wellbore. The stimulation sleeve comprises a housing having a through channel with a first end and a second end, and one or more flow ports, and a sliding sleeve disposed axially movable within the housing to open or close said flow ports, wherein said sliding sleeve is equipped with at least a first seat for receipt of an obturator to partially or fully close fluid communication in the through channel of the housing.

The present invention relates to the field of construction of wells that access subterranean hydrocarbon-bearing formations, where the productivity of such wells is improved by hydraulic stimulation of multiple sections of the wellbore.

The hydraulic stimulation treatment may for instance take the form of hydraulic fracturing, where stimulation fluids are directed from the wellbore to the formation above the formation fracture gradient; or matrix stimulation, where stimulation fluids are directed from the wellbore to the formation below the formation fracture gradient.

For both hydraulic stimulation techniques, especially in horizontal wells with long sections of the wellbore within the formation, also known as the reservoir section, it is desirable to divide the reservoir section into multiple short compartments that can be accessed sequentially during the stimulation operation. Sequentially targeting short compartments of the reservoir section allows the operator to better control over where the stimulation fluids are entering the formation, resulting in better production contribution across the entire reservoir section after the stimulation.

The present invention provides a system and method for sequentially targeting single entry points for stimulation fluids to access the formation.

BACKGROUND OF THE INVENTION

The present invention enables a sequential stage treatment of the entire wellbore, one sliding sleeve at a time, without requiring any type of intervention between stages. In addition, this invention does not result in barriers or restrictions that must be removed following the final treatment stage. The invention ensures that wellbore and stimulation fluids are directed to individual entry points one at a time.

Disclosure of the State of Art

Current methods of sequentially targeting short compartments, also known as stages, of the reservoir section are designed to target the deepest compartments first, and subsequently targeting shallower compartments. These methods require pumping operations to stop after stimulation of each stage. Before the next stage treatment, the previous one must be isolated to prevent stimulation fluids from entering the already-treated entry points.

In the case of plug-and-perforated well designs, isolation is achieved by using wireline to intervene in the wellbore to set a bridge plug above the previously treated compartment, and then new perforation clusters are placed above the bridge plug to create the entry points for the next stimulation stage.

In the case of ball or obturator-operated sliding sleeve well designs, each stage consists of sliding sleeves, which are ported to provide entry points for wellbore fluids to enter the formation. The sliding sleeves begin in a closed position, where the ports are isolated and do not allow a fluid path between the wellbore and the formation. The sliding sleeves are opened by dropping an obturator into the wellbore and pumping it down to the location of the sleeves. Each sleeve has a seat, which matches in size to the obturator that is dropped. When the obturator contacts the seat, hydraulic pressure is applied to the wellbore above the obturator and differential pressure across the obturator drives the sleeve down to expose the ports and allow fluid to enter the formation. To target individual compartments with obturator-operated sliding sleeves, different combinations of obturator and seat dimensions must be used for each stage. Smaller obturator and seat dimensions are used for the deepest stage, with sequentially larger obturator and seat dimensions for subsequent stages. Isolation between stages is achieved when the obturator lands in a seat between the stages. Both of the well designs described above result in a well with multiple barriers or restrictions that must be removed by wireline or coiled tubing intervention after the final stimulation stage is complete.

A third well design utilizes coiled tubing-operated sliding sleeves and eliminates the resulting restrictions; but this technique requires coiled tubing to remain in the wellbore during the stimulation, which introduces significant risk to the operation, especially as the number of compartments is increased.

WO 2015/039697 A1 relates to system and method for delaying actuation using a destructible impedance device. In one embodiment, a delayed actuating system can comprise a base pipe comprising a first portion of an orifice, a sliding sleeve around the base pipe, the sliding sleeve comprising a second portion of said orifice, further said sliding sleeve maneuverable into a first position, wherein said first portion of said orifice rests at least partially over said second portion of said orifice, a second position, a distance away from said second position. Further, the delayed actuating system can comprise a biasing device biasing the sliding sleeve toward the second position, and a destructible impedance device at least partially inside said orifice, the destructible impedance device preventing the sliding sleeve from leaving the first position.

US 2017/058642 A1 disclose a catch-and-engage tool conveyed with a well casing for use in a wellbore comprising an outer housing having flow ports there through, a functioning apparatus disposed within the outer housing comprising a movable member/sleeve and a holding device, a blocking apparatus disposed within the outer housing comprising a blocking member configured to block one or more flow ports in a first position, a seating apparatus positioned upstream of the blocking apparatus configured to form a seat in the tool. When a ball deployed into the well casing passes through the tool in a downstream direction and moves back in an upstream direction, the restriction element engages onto the holding device and moves the movable member such that a port in exposed to uphole pressure and the blocking member travels to a second position in a reverse direction unblocking flow ports and enabling fluid communication to the wellbore.

US 2012/234545 A1 disclose a valving system including a tubular and a sleeve slidably engaged with the tubular having a seat thereon. The sleeve is configured to occlude flow from an inside of the tubular to an outside of the tubular when in a first position, allow flow between an inside of the tubular and an outside of the tubular at a first location upstream of the seat and a second location downstream of the seat when in a second position, and allow flow between an inside of the tubular and an outside at the tubular at the first location and not the second location when in a third position. The valving system also includes a disappearing member in operable communication with the tubular and the sleeve configured to prevent movement of the sleeve to the third position until disappearance thereof.

Reference is also made to WO 2014/055332 A1, US 2013/081817 A, WO 2015/169676 A2, and WO 2015/088524 A2.

Objects of the Present Invention

It is an object to enable sequential stage treatment of the entire wellbore, one sliding sleeve at a time, without requiring any type of intervention between stages.

It is a further object to provide a stimulation sleeve with a time delay in order to hold a flow port open after activation and during the time delay, and which doses when the time delay has completed, preferable by using only one obturator.

It is a further object to provide a stimulation sleeve with an adjustable time delay.

Several configurations can be derived from the present invention:

1. Stimulation sleeve with delayed closing sequence—left closed, opened by intervention.

2. Stimulation sleeve with delayed closing sequence—left in a third closed position, opened by dissolvable/disintegrating technology, or a dual-action-type plug, which can be removed using pressure cycles.

The invention can be used for any type of multi-stage stimulation, including hydraulic fracturing treatment.

SUMMARY OF THE INVENTION

The above objects are achieved with a method for well completion in a subterranean wellbore, comprising the steps:

- running a tubing string with a number of stimulation sleeves into the wellbore, each stimulation sleeve comprises a housing having a through channel with a first end and a second end, one or more flow ports and a sliding sleeve disposed axially movable within the housing to open or close said flow ports,
- dropping an obturator into a well stream in the tubing and to land the obturator on a first obturator seat to partially or fully close fluid communication in the through channel of the housing,
- build up pressure to shift the sliding sleeve axially in the housing to open the flow ports,
- engaging a time delay mechanism for controlled travel of the sliding sleeve in the housing to hold the flow ports open a predetermined time, wherein time delay is adjustable for individual sleeves,
- closing the flow ports after the sliding sleeve has moved the predetermined time, and
- retracting the obturator seat to release the obturator.

The time delay mechanism can be accommodated in a hydraulic chamber on the inner surface of the housing, and the method can comprises the following steps to set the time delay:

- regulating flow in the hydraulic chamber by restricting hydraulic fluid flow from one side of the chamber to the other side of the chamber.

The flow ports can be opened by aligning longitudinal slits in the sliding sleeve with the flow ports, and the flow ports can be closed by allowing the longitudinal slots in the sliding sleeve to move out of alignment with the flow ports.

A second obturator can be landed in a second obturator seat, said second obturator seat can be located uphole of the first obturator seat, and to build up pressure to shift the sliding sleeve axially in the housing to re-open the flow ports by aligning production ports in the sliding sleeve with the flow ports.

The second obturator seat can be retracted to release the second obturator after the production ports in the sliding sleeve are aligned with the flow ports.

The production ports in the sliding sleeve can be filled with a dissolvable material that dissolves when exposed to well fluids.

The production ports in the sliding sleeve can be mechanically opened, by applying pressure cycles on one or more dual action plugs.

A shifting tool can be conveyed into the wellbore to shift the stimulation sleeves to open position after the stimulation is completed, A second obturator can be dropped into the well stream in the tubing string and to land the second obturator on the obturator seat to partially or fully close fluid communication in the through channel of the housing,

- build up pressure to shift the sliding sleeve axially in the housing to close the flow ports,
- engaging the time delay mechanism for controlled travel of the sliding sleeve in the housing to hold the flow ports open a predetermined time, and
- retracting the obturator seat to release the obturator.

The obturator after being released from the obturator seat of the stimulation sleeve can travels with gravity and/or fluid flow to the next stimulation sleeve to repeat the process from the previous stimulation sleeve.

A floating piston with a spring loaded rod as part of the time delay mechanism can add pressure compensating abilities to the time delay mechanism, by letting the spring loaded rod's depth of penetration inside a through bore in the floating piston, being determined by the differential pressure across the floating piston, hence not letting increased differential pressure across the obturator affect the flow of fluid across the floating piston.

The time delay can be adjusted by reducing or increasing a narrow flow area past the rod through the through bore.

The time delay can be adjusted by using fluid with higher or lower viscosity in the hydraulic chamber.

One or more tension bolt(s) that can prevents the sliding sleeve from shifting to the open position has a predefined tension strength, and by monitoring the surface pump pressure while pressuring up to part the tension bolt one can calculate the differential pressure across the obturator in the obturator seat.

The above objects are also achieved with a stimulation sleeve for well completion in a subterranean wellbore, comprising:

- a housing having a through channel with a first end and a second end, and one or more flow ports, and
- a sliding sleeve disposed axially movable within the housing to open or close said flow ports, wherein said sliding sleeve is equipped with at least a first obturator seat for receipt of a obturator to partially or fully close fluid communication in the through channel of the housing, and
- an adjustable time delay mechanism to allow the sliding sleeve to axially travel in the housing at a predetermined speed to open or close said flow ports.

The sliding sleeve can comprises a first closed part for closing the flow ports and a second partially open part equipped with longitudinal slits for alignment with the flow ports to open the flow ports.

The sliding sleeve can comprises a third closed part for closing the flow ports.

The sliding sleeve can comprises a fourth partially open part equipped with production ports for alignment with the flow ports to open the flow ports.

The production ports in the sliding sleeve can be filled with a dissolvable material that dissolves when exposed to well fluids.

The production ports in the sliding sleeve can comprises one or more dual action plugs, which are opened by applying pressure cycles.

The obturator seat can comprises a plurality of radially placed and retractable plungers being activated by the movement of the sliding sleeve.

At least one gasket can be placed upstream of said plungers.

The sliding sleeve can comprises a second obturator seat for receipt of a second obturator, said second obturator seat being located upstream of the first obturator seat, in order to build up pressure and to shift the sliding sleeve axially in the housing to open the flow ports by aligning the production ports in the sliding sleeve with the flow ports.

The time delay mechanism can be accommodated in a hydraulic chamber on the inner surface of the housing, and comprises a flow restrictor.

The time delay mechanism can comprises a metering device with a piston surface area and longitudinal holes, each of which contains a hydraulic metering orifice, which separates two sides of the piston.

The time delay mechanism can comprises a timing valve with a porous filter media rod that allows hydraulic fluid to pass from one side of the chamber to the other side of the chamber.

The porous filter media rod can be connected to a spring for regulation of how much of the porous media rod that is exposed to the hydraulic fluid.

The time delay mechanism can comprises a floating piston with a through bore that allows hydraulic fluid to pass from one side of the chamber to the other side of the chamber.

The floating piston can comprises a spring loaded rod accommodated in the through bore, defining a narrow flow area past the rod through the through bore.

The differential pressure across the floating piston can regulate the penetration depth of the spring loaded rod inside the through bore.

The sliding sleeve can be restricted from moving by one or more tension bolts.

DESCRIPTION OF THE DIAGRAMS

Embodiments of the present invention will now be described, by way of example only, with reference to the following diagrams wherein:

FIG. 1 shows a first embodiment of the present invention.

FIG. 2*a*-2*e* show operation of the first embodiment of the invention.

FIG. 3 shows a second embodiment of the present invention.

FIG. 4*a*-4*h* show operation of the second embodiment of the invention.

Figure 7A:
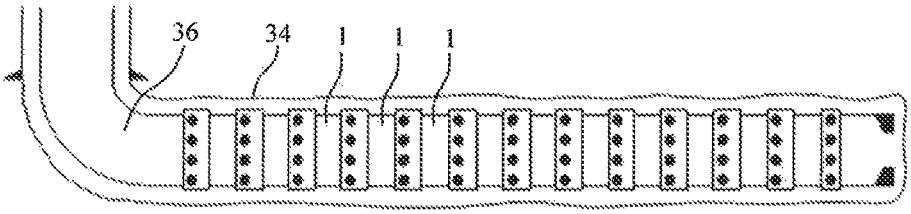
Figure 7B:
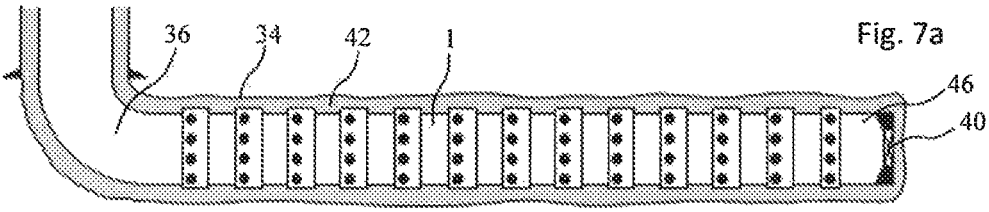
Figure 7C:
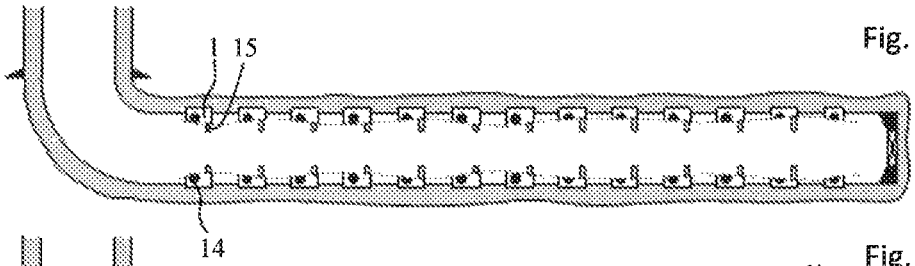
Figure 7D:
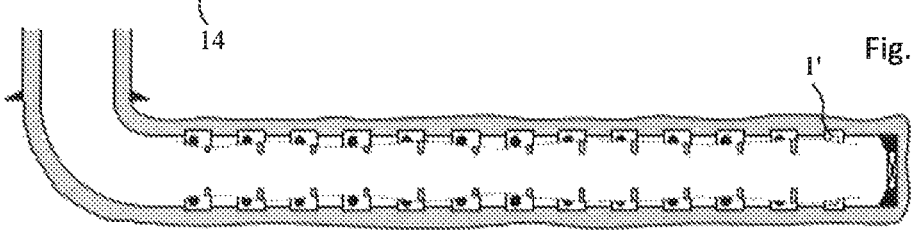
Figure 7E:
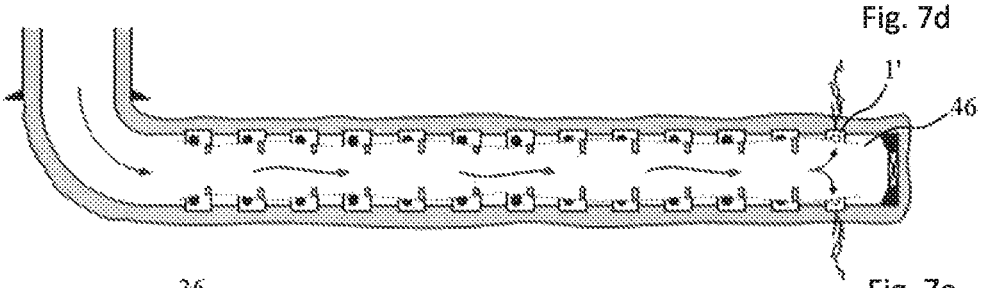
Figure 7F:
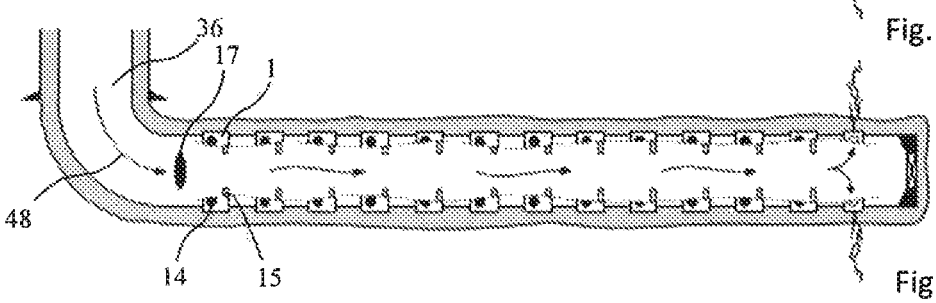
Figure 7G:
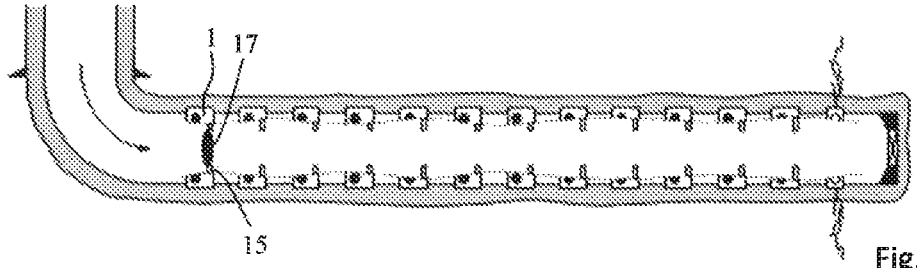
Figure 7H:
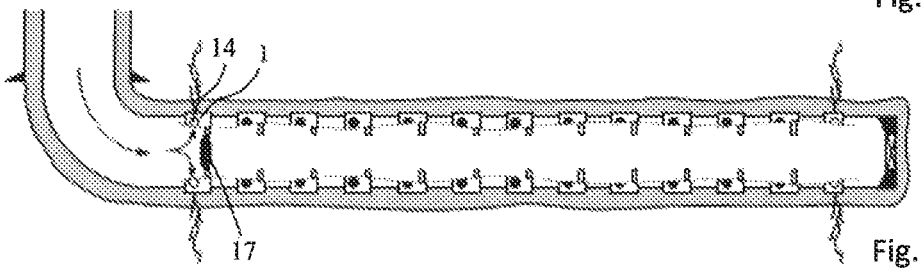
Figure 7I:
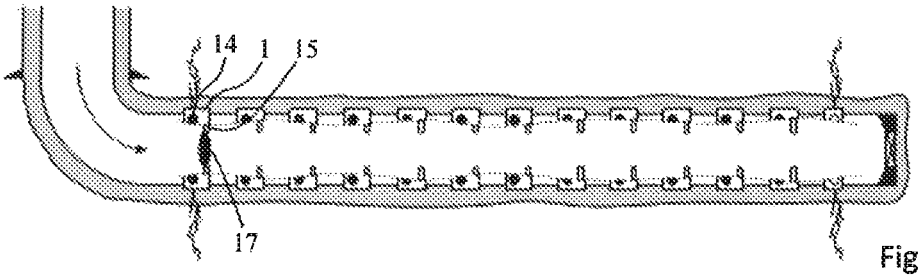
Figure 7J:
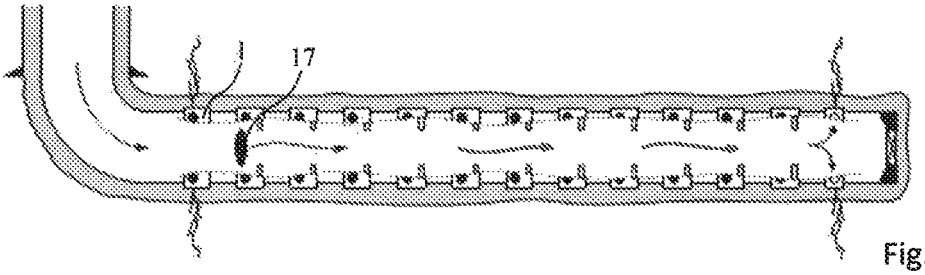
Figure 7K:
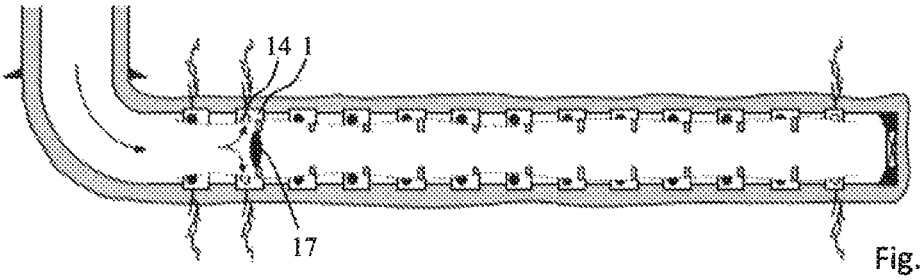
Figure 7L:
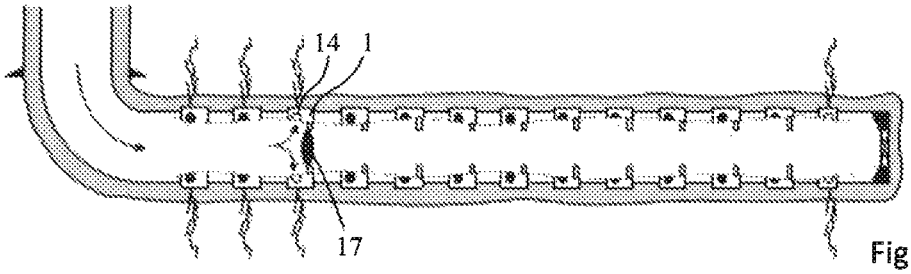
Figure 7M:
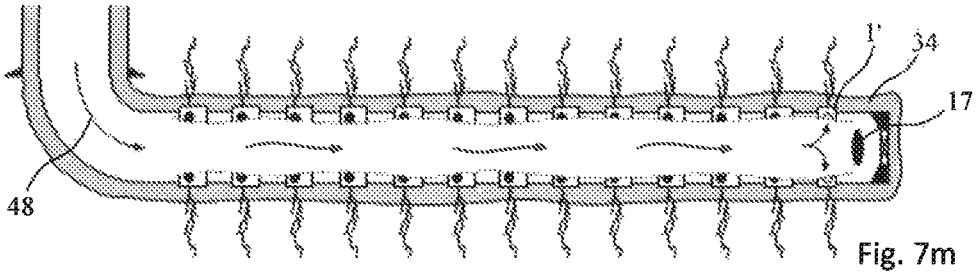
Figure 7N:
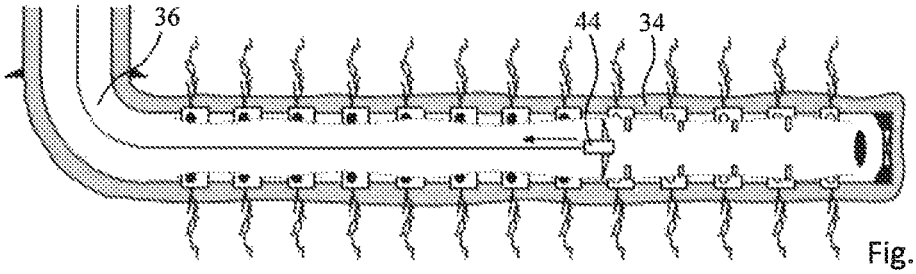
Figure 7O:
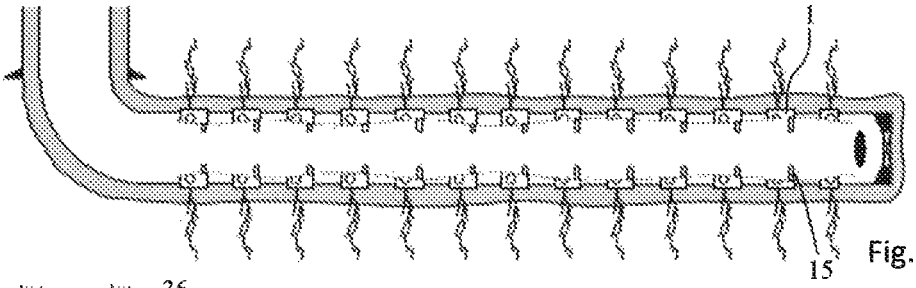
Figure 7P:
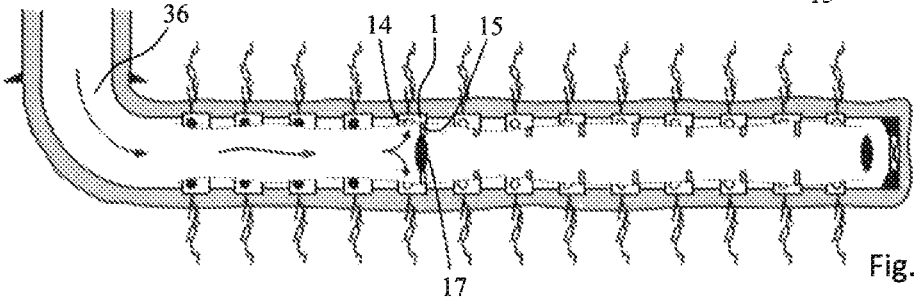

FIG. 7*a*-7*p* show application of the first embodiment of the invention.

FIG. 8*a*-8*e* show application of the second embodiment of the invention.

Figure 9A:
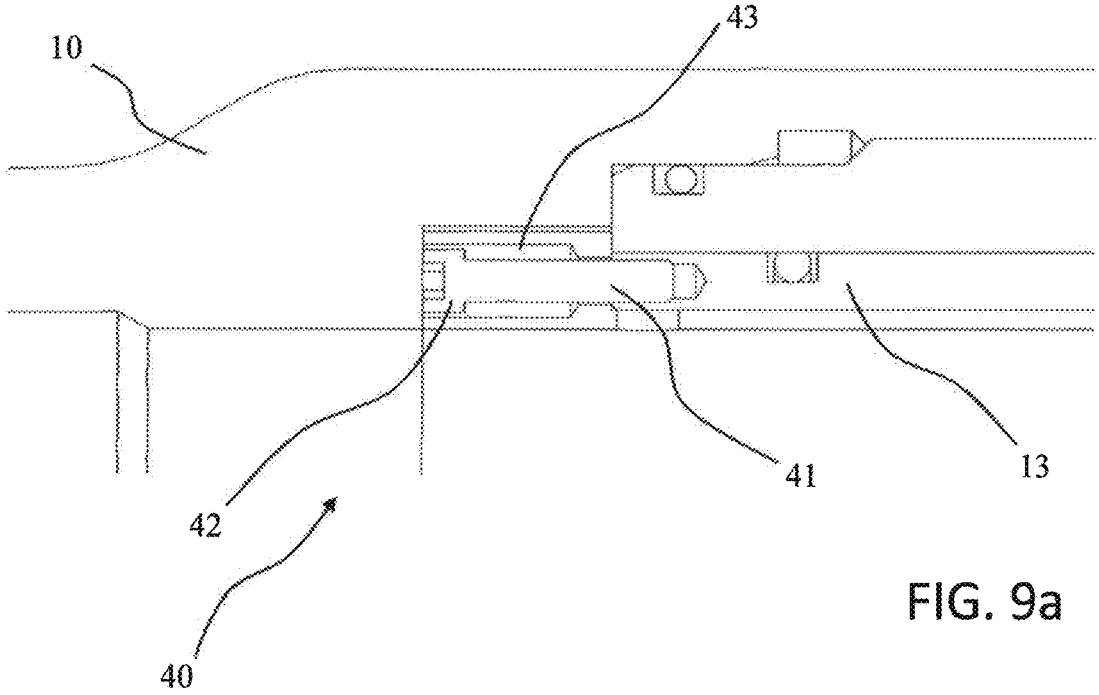
Figure 9B:
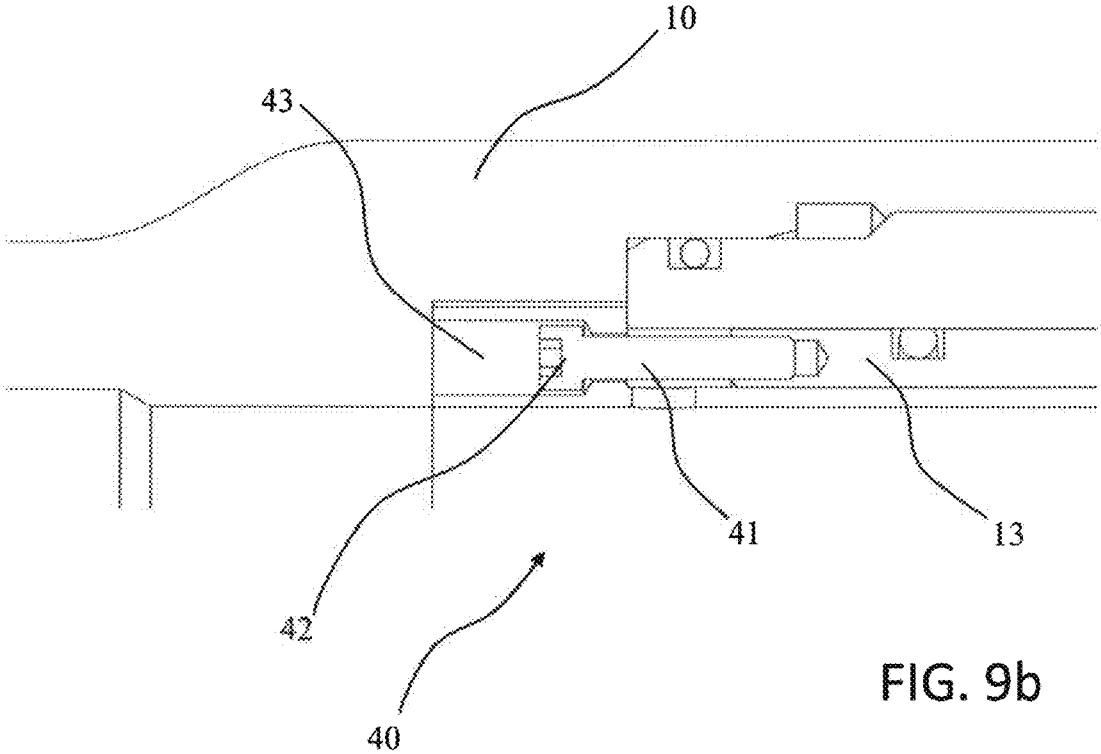

FIG. 9*a*-9*b* show an embodiment in where the stimulation sleeve is equipped with one or more tension bolt assemblies.

Figure 10A:
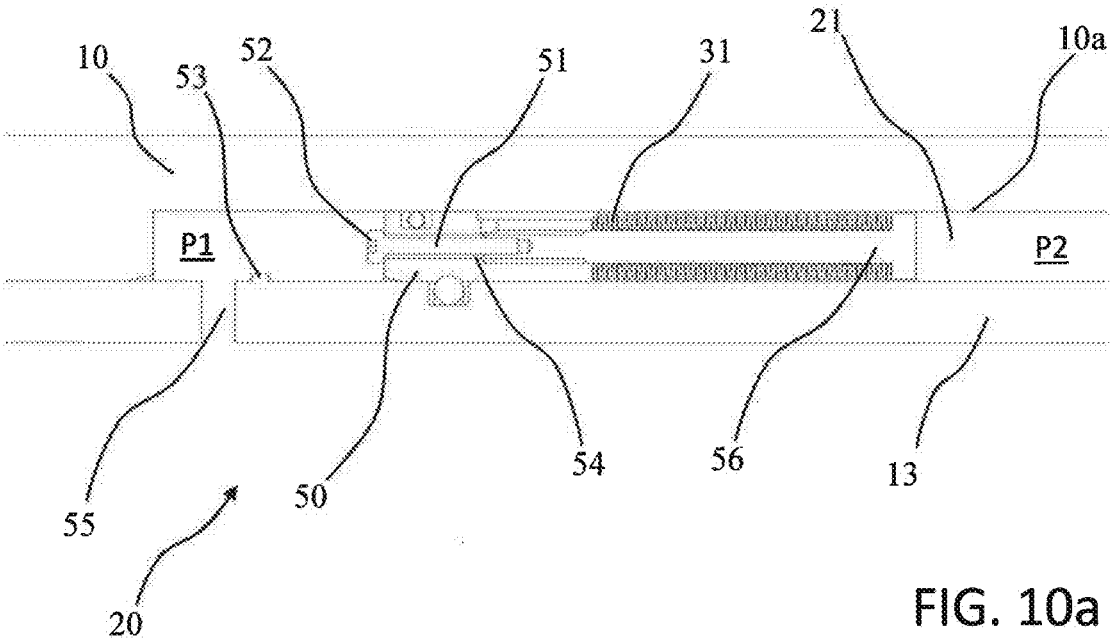
Figure 10B:
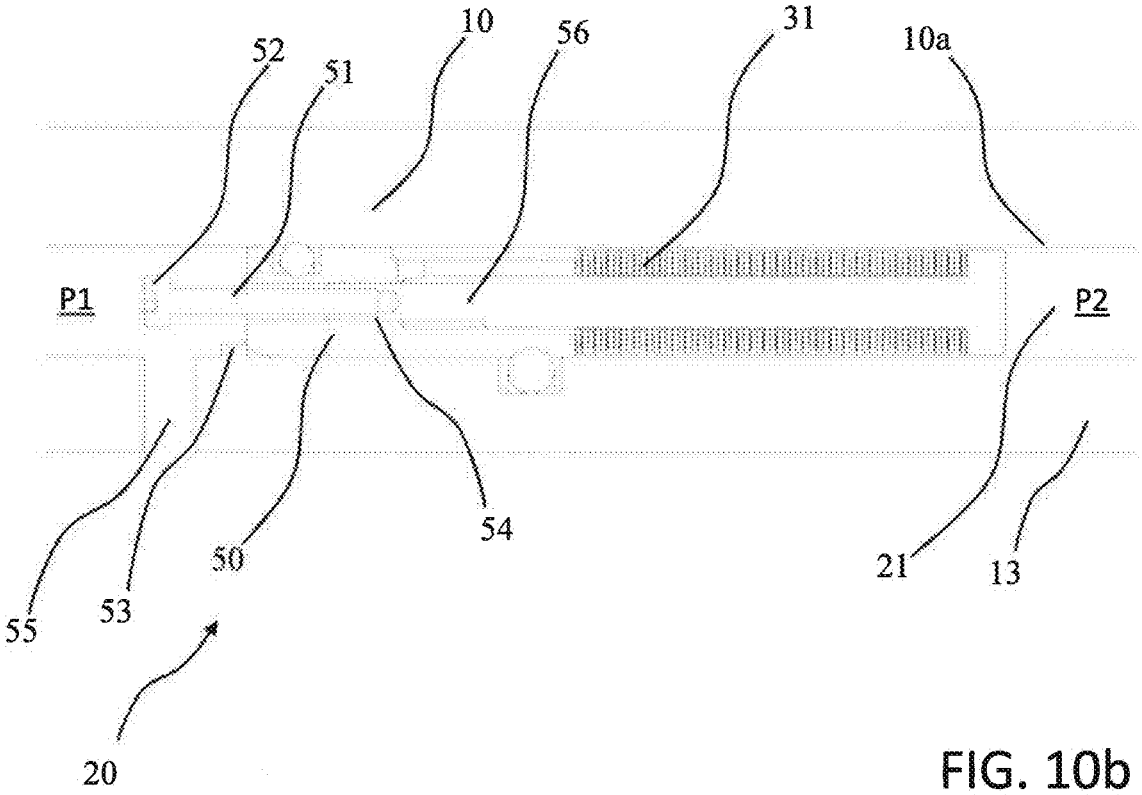

FIGS. 10*a*-10*b* show a further example of a time delay mechanism of the invention.

Figure 11A:
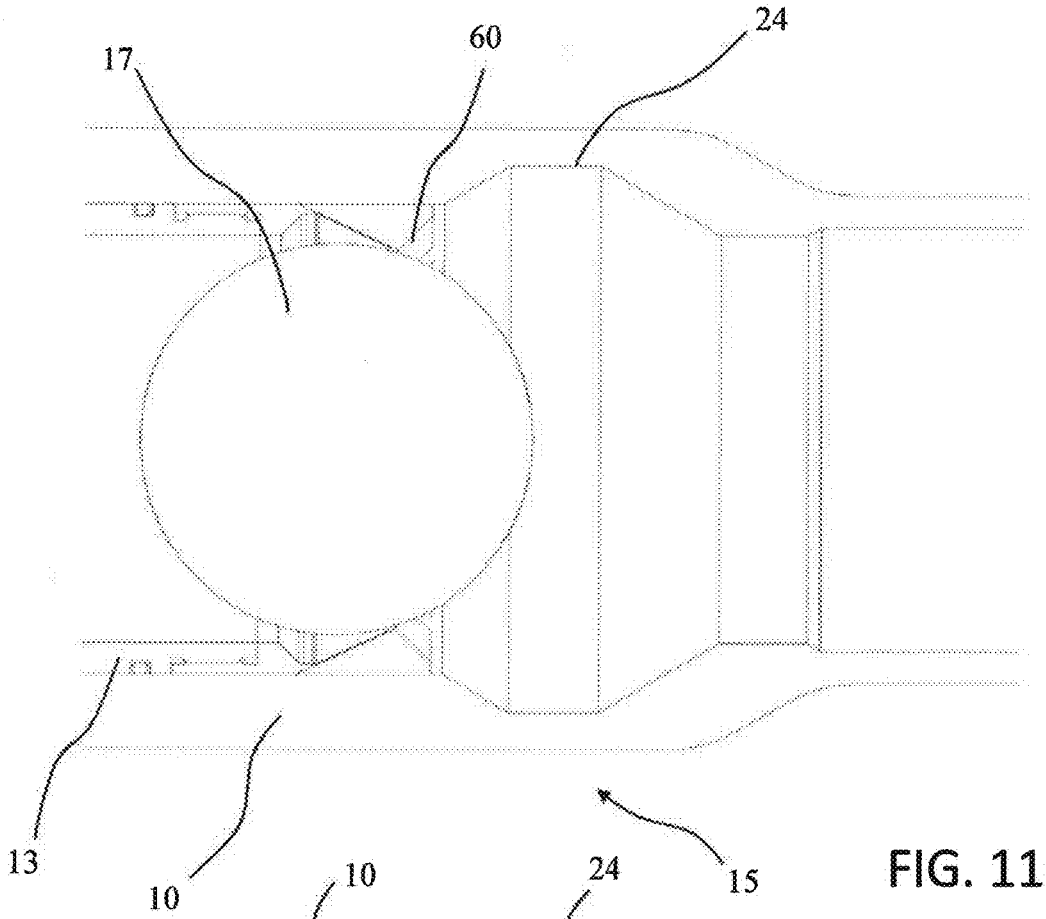
Figure 11B:
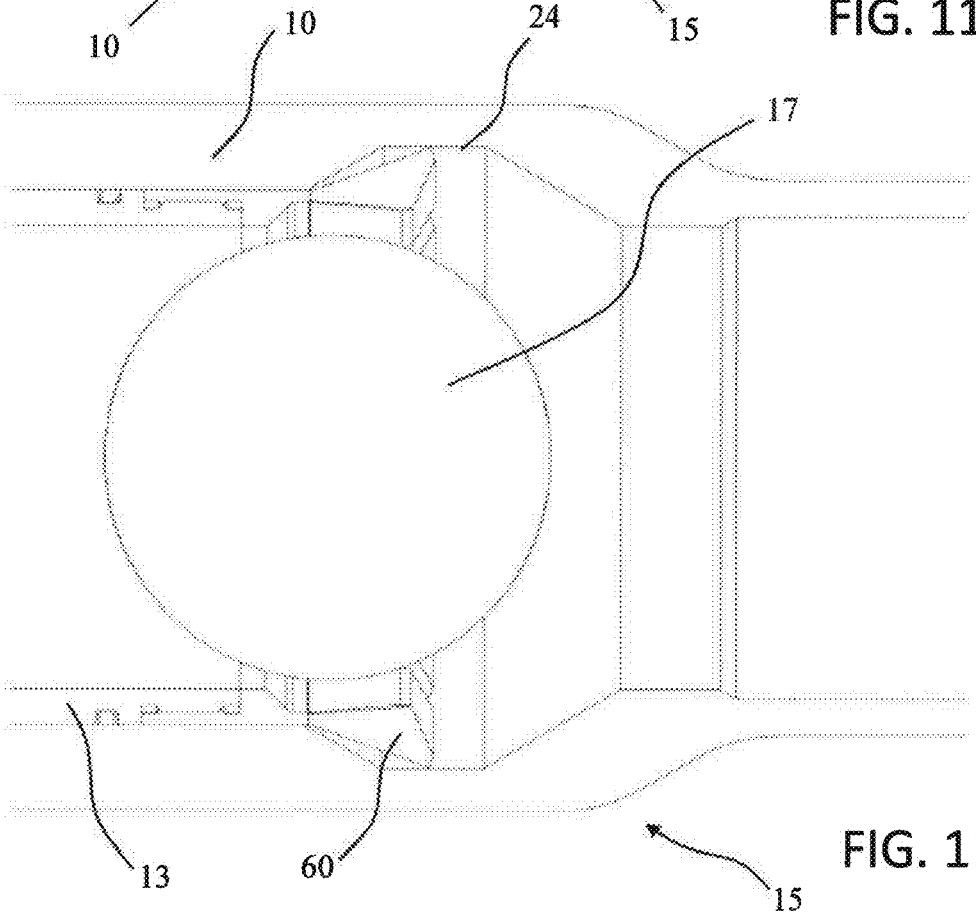
Figure 11C:
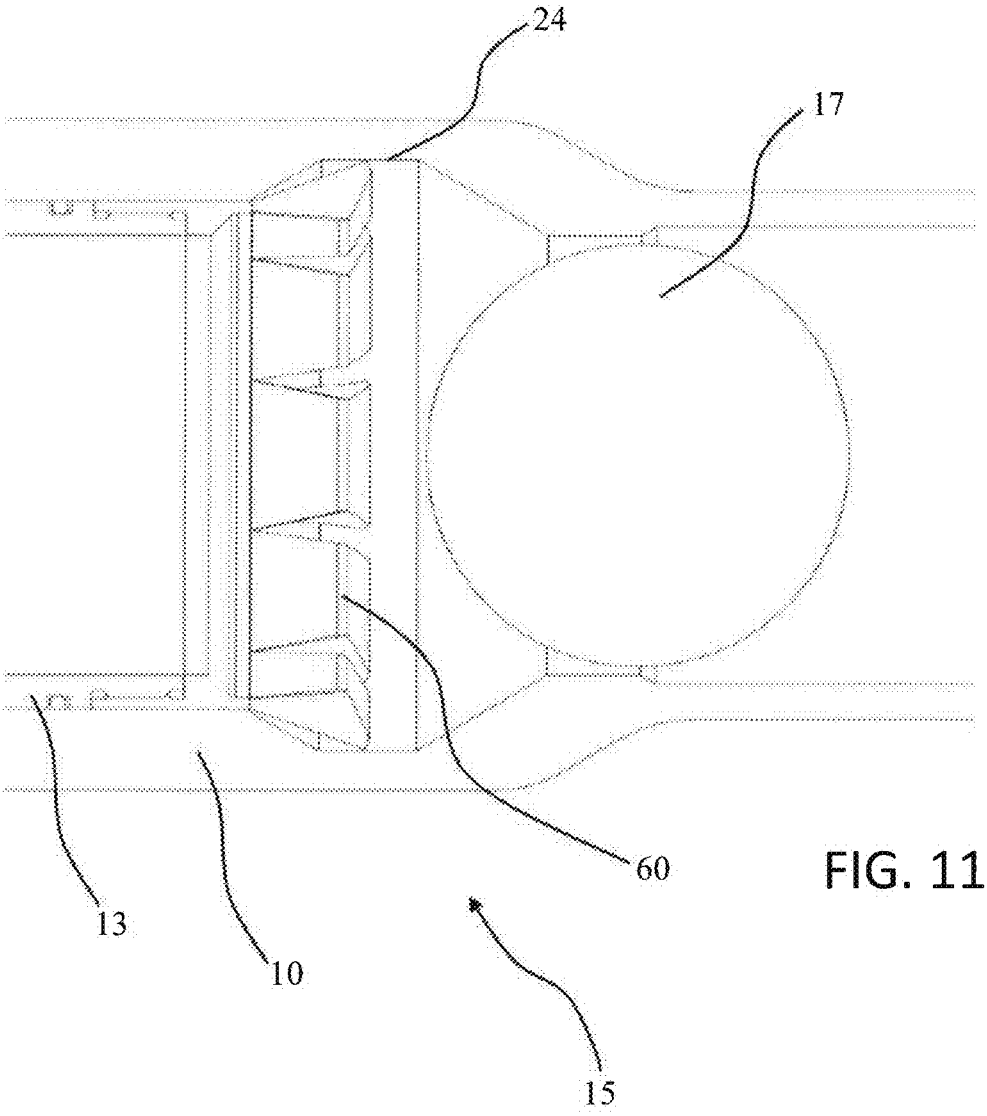

FIGS. 11*a*-11*c* show a further example of an obturator seat according to the invention.

Figure 12A:
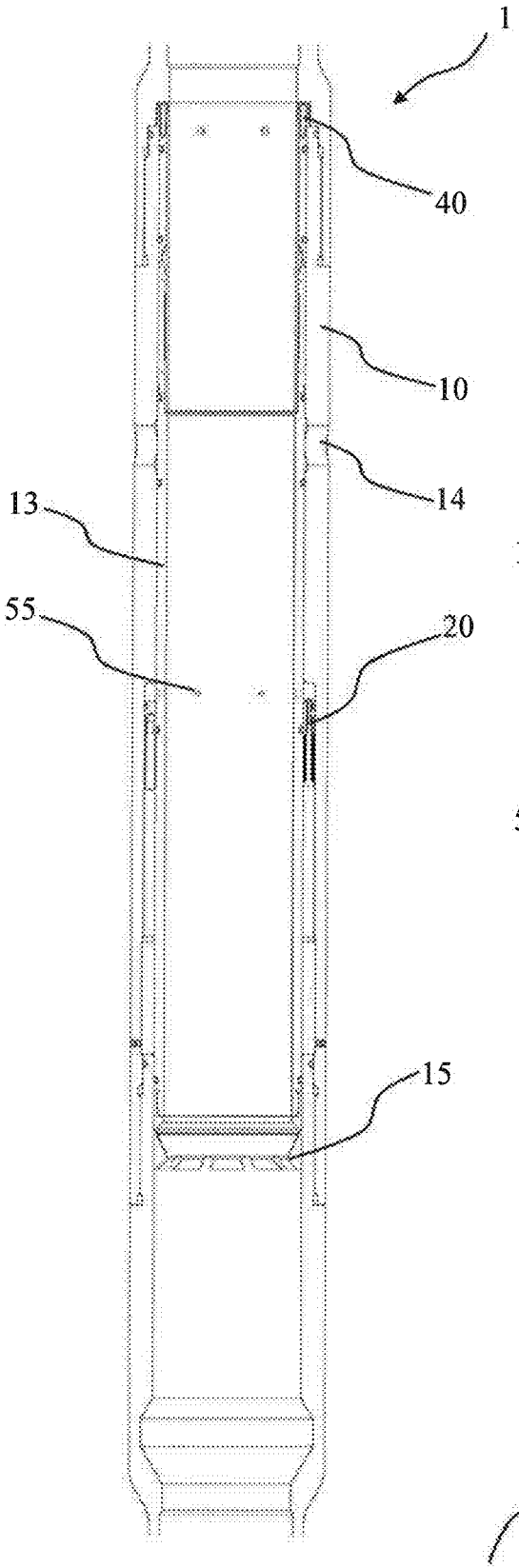
Figure 12B:
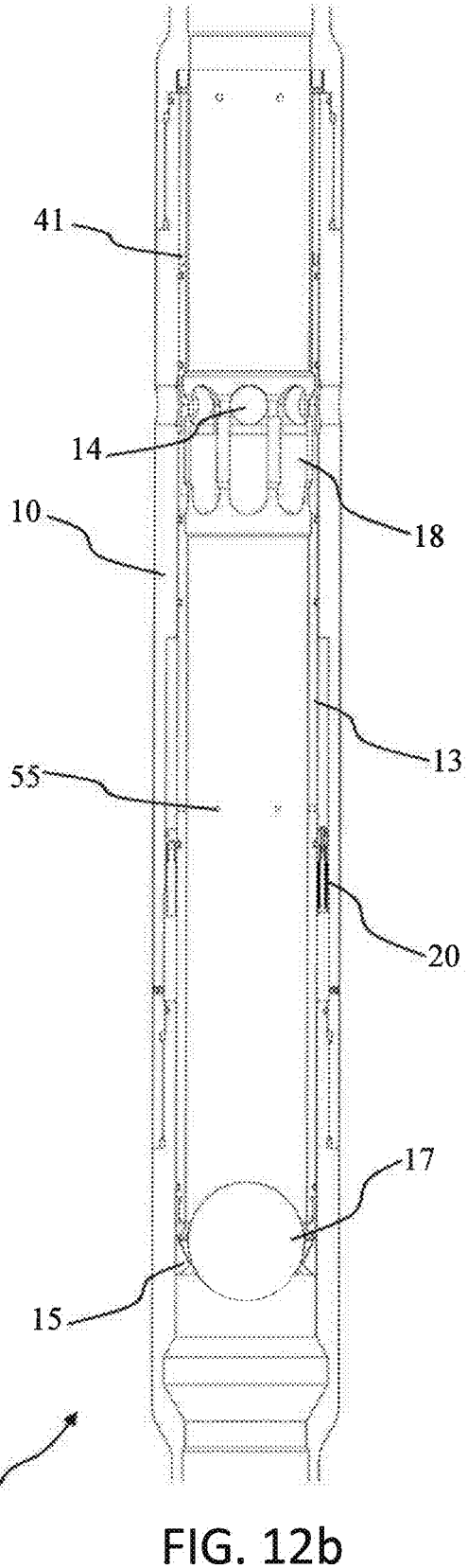

FIGS. 12*a*-12*b* show a further embodiment of the invention, with the features of FIGS. 9*a*-9*b*, 10*a*-10*b*, and 11*a*-11*c*.

DESCRIPTION OF PREFERRED EMBODIMENTS OF THE INVENTION

Figure 1:
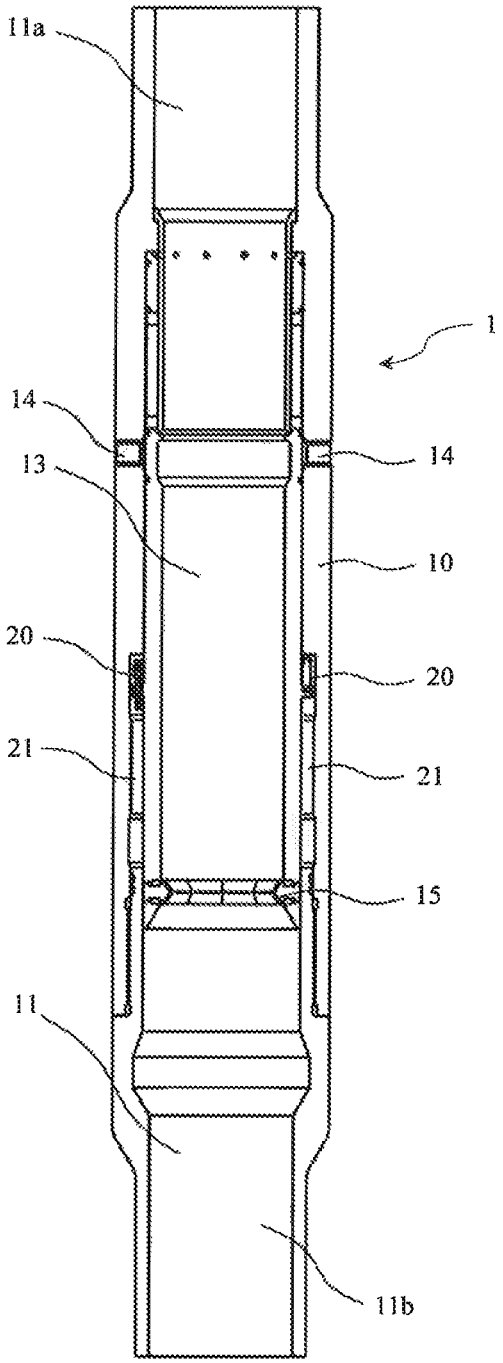
Figure 3:
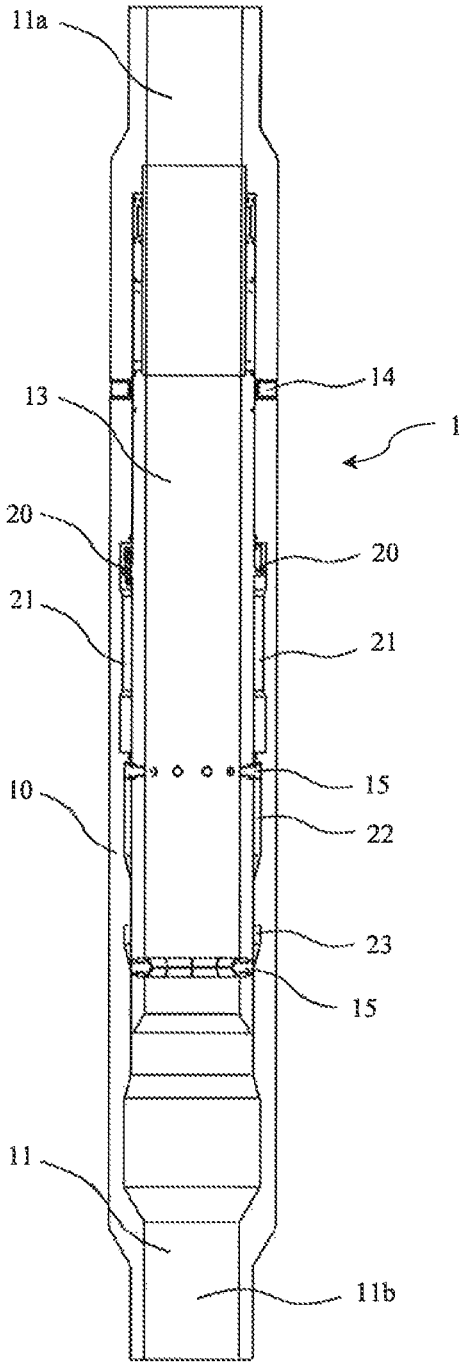

The present invention relates to a stimulation sleeve 1 for well intervention in a subterranean wellbore, and comprises a housing 10 having a through channel 11 with a first end 11*a* and a second end 11*b*, one or more flow ports 14, and a sliding sleeve 13 disposed axially movable within the housing 10 to open or close the flow ports 14. The sliding sleeve 13 is equipped with at a first landing profile in the form of for instance an obturator seat 15, for instance a ball seat as seen in FIG. 1, for receipt of an obturator 17 in the form of for instance a drop ball or dart, to partially or fully close fluid communication in the through channel 11 of the housing 10. As seen in FIG. 3 the sliding sleeve 13 may also comprise a second landing profile in the form of a second obturator- or ball seat 15. The stimulation sleeve 1 further comprises a time delay mechanism 20 to allow the sliding sleeve 13 to axially travel or being displaced in the housing 10 at a predetermined speed to open or close the flow ports 14.

Figure 4G:
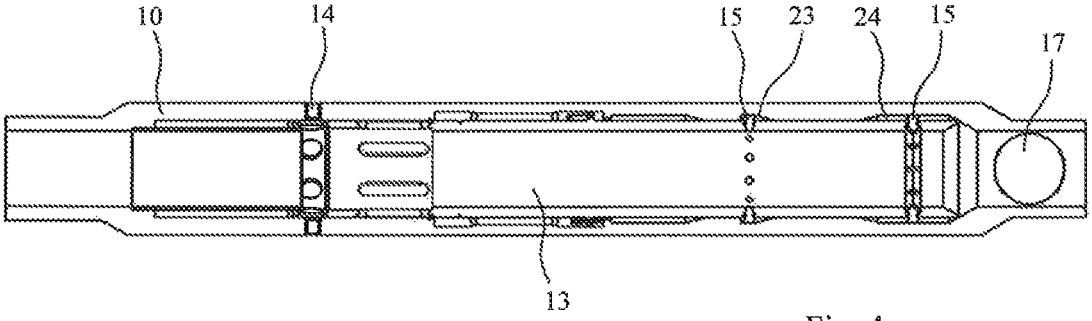
Figure 5:
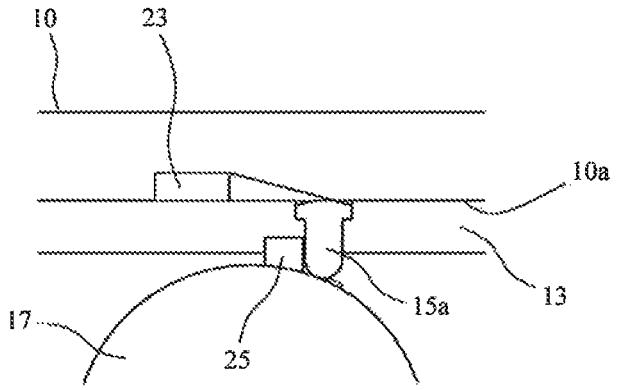
FIG. 5 shows in detail an example of a landing profile of the invention.

An example of the landing profile in the form of an obturator seat 15 is shown in more detail in FIG. 5, and comprises in one embodiment a plurality of spring loaded plungers 15*a* placed radially in the sliding sleeve 13. When the plungers 15*a* are forced against the inner surface 10*a* of the housing 10 they are pushed out into the sliding sleeve 13, i.e. the plungers 15*a* protrude inwardly in the sliding sleeve 13. The housing 10 may comprise a longitudinal compartment or cavity 23, 24 on the inside surface 10*a*, and when the plungers 15*a* in the sliding sleeve 13 passes the cavity 23, 24, the plungers 15*a* are allowed to retract to let the obturator 17 pass. As seen in FIG. 2*e* the plungers 15*a* are retracted in the cavity 24 and the obturator 17 can pass. FIG. 4*g* shows that the first set of plunger 15*a*, being the first obturator seat 15, are retracted in the cavity 24 and the second set of plungers 15*a*, being the second obturator seat 15, are retracted in the cavity 23.

Figure 6:
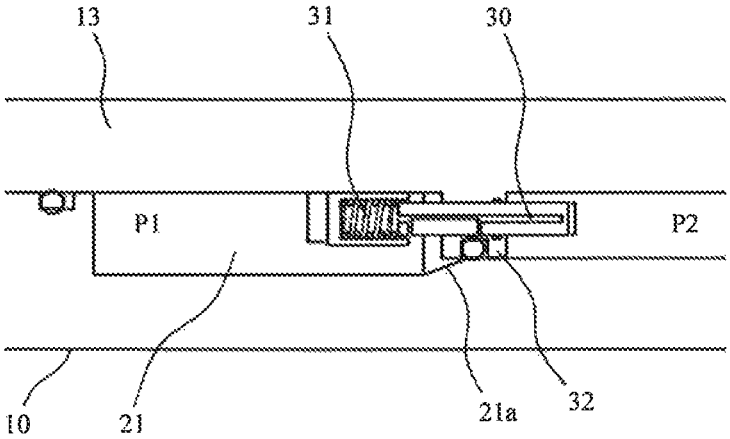
FIG. 6 shows in detail an example of a time delay mechanism of the invention.

An example of a time delay mechanism 20 is shown in more detail in FIG. 6. The time delay mechanism 20 is connected to the sliding sleeve 13 and is accommodated in a longitudinal chamber or cavity 21 on the inside surface 10*a* of the housing 10. The time delay mechanism 20 comprises a flow restrictor. The cavity 21 is filled with a hydraulic fluid, such as oil. When the sliding sleeve 13 is axially displaced in the housing 10, the time delay mechanism 20 will hit a shoulder 21*a* and pressurized fluid, such as oil, will be forced from one side P2 of the cavity 21 to the other side P1 of the cavity 21. Hence, the sliding sleeve 13 will travel at a predetermined speed. The time delay mechanism 20 can for instance comprise a timing valve with a porous filter media rod 30 that allows the pressurized oil to pass from P2 to P1. A spring 31 can regulate how much porous media rod 30 that is exposed, and the total permeability will change with delta pressure and the sliding sleeve 13 will travel at constant speed regardless of delta pressure between P1 and P2. The time delay mechanism 20 may further comprise a gasket in the form of for instance an O-ring 32 that seals against the inner surface 10*a* of the housing 10.

The time delay mechanism 20 can in an alternative embodiment be a metering device accommodated in a hydraulic chamber on the inner surface of the housing 10, and comprise a piston surface area and longitudinal holes, each of which contains a hydraulic metering orifice, which separates two sides of the piston.

The invention takes tubular form with an internal diameter, which makes up a portion of the wellbore, and an outside diameter, which is exposed, to the annulus and formation. It is connected end to end with the lower completion tubulars. Any number of stimulation sleeves 1 can be deployed at intervals along the lower completion tubular string, all of which can function in the same way. The stimulation sleeve 1 according to the invention comprises the housing 10 with flow ports 14 that hydraulically connect the wellbore to the formation. The flow ports 14 can be open to allow flow to or from the formation, or closed to prevent flow and contain pressure. The position of the inner sliding sleeve 13 determines whether the flow ports 14 are open or closed.

The inner sliding sleeve 13 of a first embodiment of the invention shown in FIGS. 1 and 2*a*-2*e* comprises an upper section with three distinct surfaces 13*a*-13*c* that can be located across the housing flow ports 14, depending on the sliding sleeve 13 positions. The lower surface 13*a* is solid, the middle surface 13*b* has machined holes in the form of for instance longitudinal slits 18, and the upper surface 13*c* is solid. When the tool is conveyed into the well, the inner sliding sleeve 13 is in its uppermost first position and the solid surface 13*a* blocks the housing flow ports 14, preventing flow through them. If the sleeve 13 moves down into a second position, the middle surface 13*b* can be aligned with the flow ports 14, and the longitudinal slits 18 in the sleeve 13 allows flow from the wellbore through the flow ports 14 and into the formation. If the sleeve 13 moves down further past the second position, the upper surface 13*c* is then aligned with the flow ports 14 in a third position and contains pressure within the wellbore.

The inner sliding sleeve 13 has a middle section which comprises the time delay mechanism 20 in the form of for instance a piston surface area and machined longitudinal holes, each of which contains a hydraulic metering orifice which separates the two sides of the piston, as explained above in relation to the time delay mechanism 20. On both sides of the piston surface area is the hydraulic chamber 21 filled with hydraulic fluid. This hydraulic chamber 21 is balanced in pressure with the wellbore under all steady state conditions.

The inner sliding sleeve 13 has a lower section, which comprises the landing profile, as for instance explained above in relation to the obturator seat 15. The landing profile can be extended or retracted, depending on the position of the inner sleeve 13. While the sleeve 13 is in the first and second positions, the landing profile is extended, meaning the internal diameter is reduced and prevents any obturator of larger diameter from passing through it. When the sleeve 13 is in the third position, the landing profile is retracted to a larger ID, allowing any obturator of smaller diameter to pass through it.

If any obturator 17 with a smooth surface is prevented from passing the landing profile 15, the wellbore section above the obturator 17 is isolated from the wellbore section below the obturator. If pressure above the obturator is higher than the pressure below the obturator, a piston force results and acts to drive the inner sliding sleeve 13 in the downward direction. The speed at which the sliding sleeve 13 moves is controlled by the hydraulic orifices, i.e. the time delay mechanism 20, which allow the hydraulic fluid to meter from one side of the sleeve piston to the other side.

During well operations, one or more stimulation sleeves 1 are deployed into the well. Once the tubular string is positioned at the target depth, cementing operations can be conducted to place cement in the annulus. Alternatively to cement, the operator can choose to use open-hole packers to create the annular isolation between the sleeves and the rest of the well.

After annular isolation is established, the wellbore is pressure tested against the closed stimulation sleeves 1 and the remaining tubulars. Toe prep is then conducted, either through an intervention-based toe perforation method, or by opening a remotely operated toe sleeve, thereby creating a flow path at the bottom of the well.

When it is desirable to begin the stimulation operation, an obturator 17 is deployed into the wellbore and pumped down to the uppermost stimulation sleeve 1. The obturator 17 makes contact with the obturator seat 15 in the stimulation sleeve 1, which in turn initiates the metering shift of the sliding sleeve 13 to the second position where the flow ports 14 are opened.

The stimulation stage is pumped through the open flow ports 14. Meanwhile, the sliding sleeve 17 continues to shift downward. The time at which the flow ports 14 remain open can be determined by using different number of orifices and/or using different permeability factor in the time delay mechanism 20.

At the predetermined time delay, the sliding sleeve 13 moves into the third position where the flow ports 14 are isolated. At the same time, the landing seat 15 retracts and allows the obturator 17 to pass the first stimulation sleeve 1 to the second stimulation sleeve 1 in the sequence, and the stimulation stage operation is repeated.

When the obturator 17 is released from the final stimulation sleeve 1 in the sequence, it continues down to the bottom of the well below the toe perforations or toe sleeve. Alternatively, it can land in a fixed landing profile above the toe sleeve, thereby creating a pressure tight tubular system, which may allow the operator to perform wellhead work without being exposed to a live well.

To open the stimulation sleeves 1 for production, wireline or coiled tubing intervention is performed using a shifting tool, which locates inside the shifting profile of each sleeve. The sliding sleeve 13 is mechanically shifted to the open position. A check valve may or may not be used to allow the sleeve 13 to be shifted upwards without a hydraulic delay.

Figure 2A:
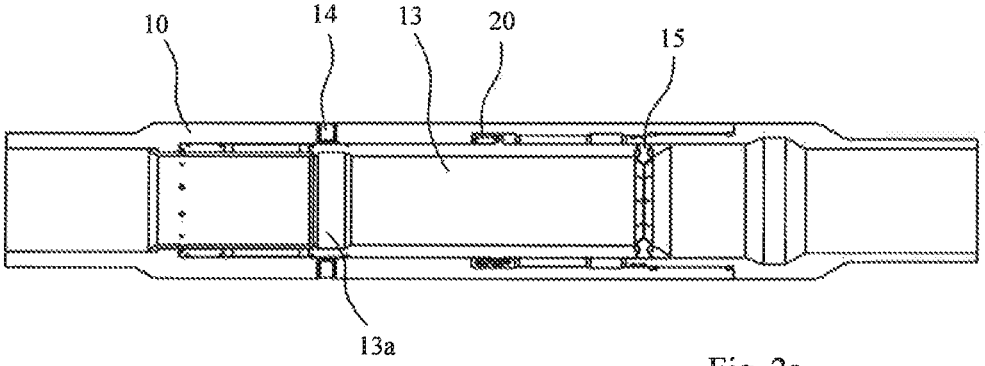
Figure 2B:
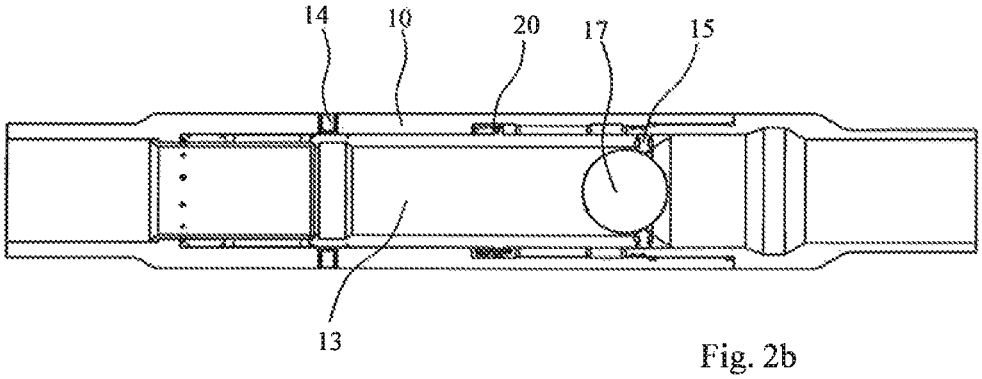
Figure 2C:
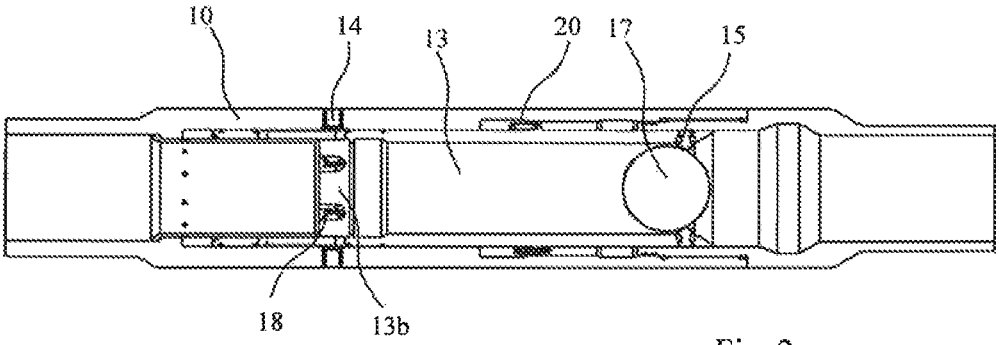
Figure 2D:
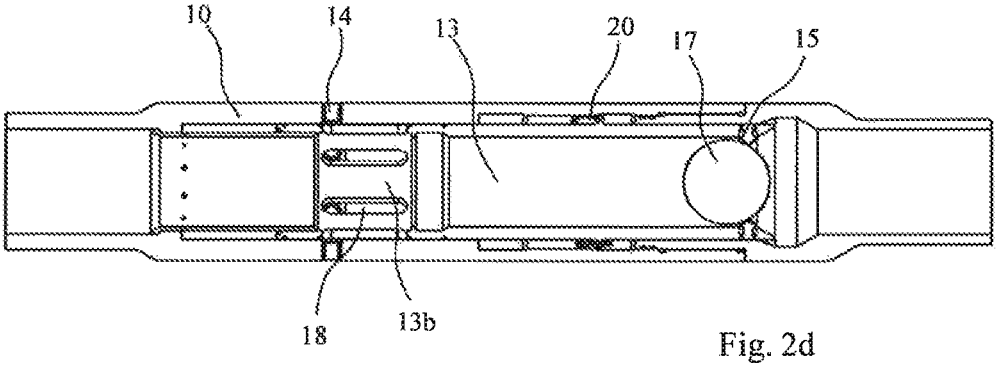
Figure 2E:
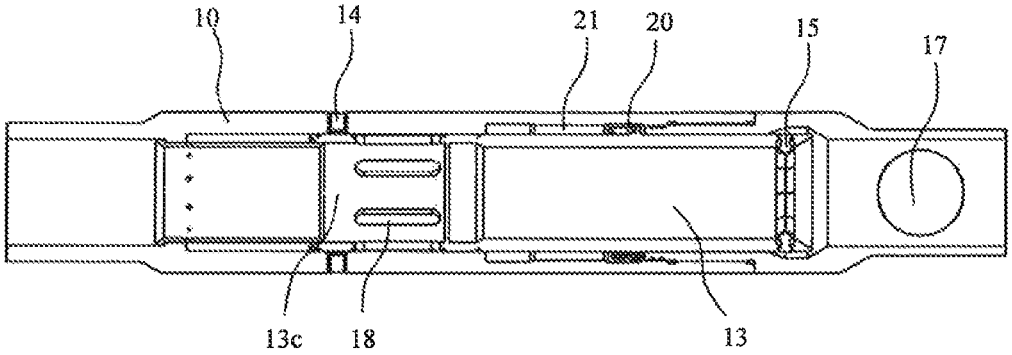

FIG. 2*a*-2*e* shows the above procedure of using the first embodiment. In FIG. 2*a*, the stimulation sleeve 1 is run into the wellbore. In FIG. 2*b*, the obturator 17 is landed in the obturator seat 15 and pressure is built up. The sliding sleeve 13 is thereafter shifted in the housing 10, FIG. 2*c*, and the flow ports 14 are open and the time delay mechanism 20 is activated. In FIG. 2*d* the sliding sleeve 13 shifts to the end of open position, and in FIG. 2*e* the sliding sleeve 13 moves to closed position, the obturator seat 15 retracts and the obturator 17 is released. The obturator 17 moves to the next stimulation sleeve 1.

FIGS. 3 and 4*a*-4*h* shows a second embodiment of the invention. The alternative configuration of the invention comprises a second landing profile in the form of an obturator seat 15 which remains retracted in the first and second positions, but is then extended in the third position. The second obturator seat 15 can be used to shift the sliding sleeve 13 to a fourth open position by deploying a second obturator 17 into the wellbore and pumping it through all the stimulation sleeves 1. In this configuration, it is desirable to prevent fluid leak off through the fourth position production ports 19 until all stimulation sleeves 1 have been shifted to the fourth position. This can be accomplished by using dissolvable material for plugs that are installed into the fourth position production ports 19 for a temporary barrier.

Another way to prevent leak off are to use dual action type plug design which are removed hydraulically from the fourth position production ports 19 by under balancing the well when the well is initially put on production. Flow from the formation into the wellbore removes the plugs and the well is produced as normal.

Figure 4A:
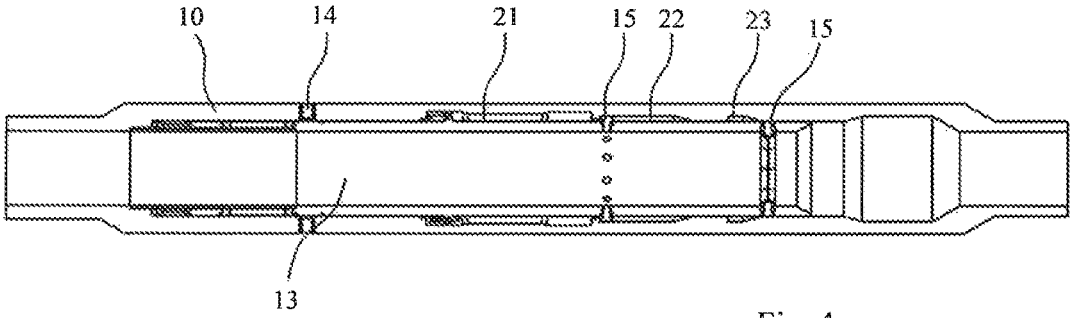
Figure 4B:
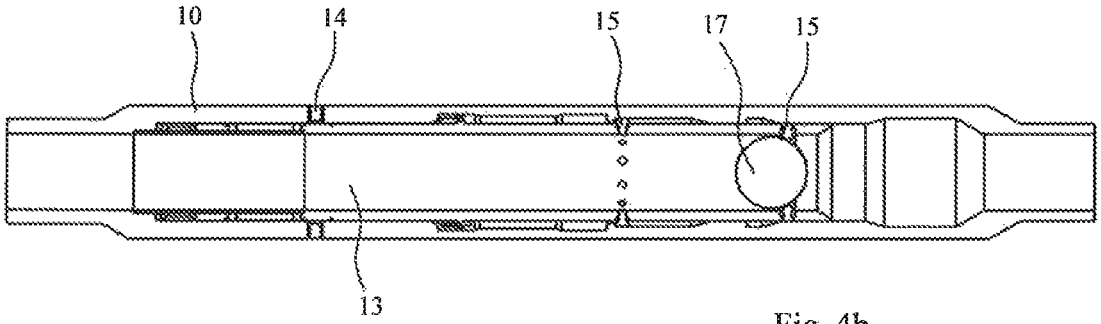
Figure 4C:
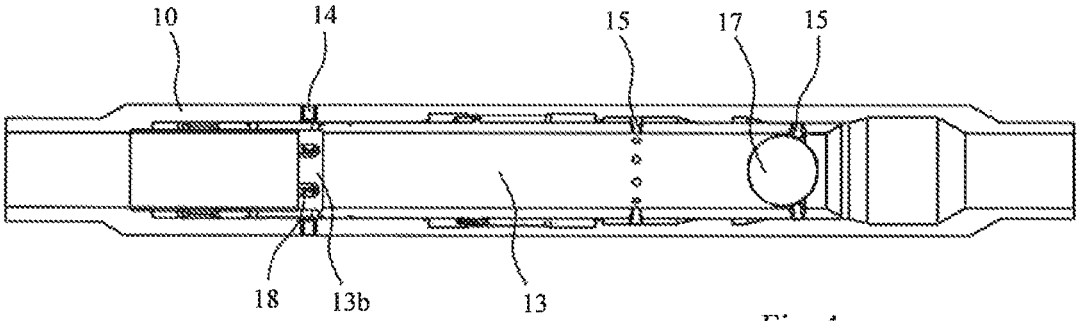
Figure 4D:
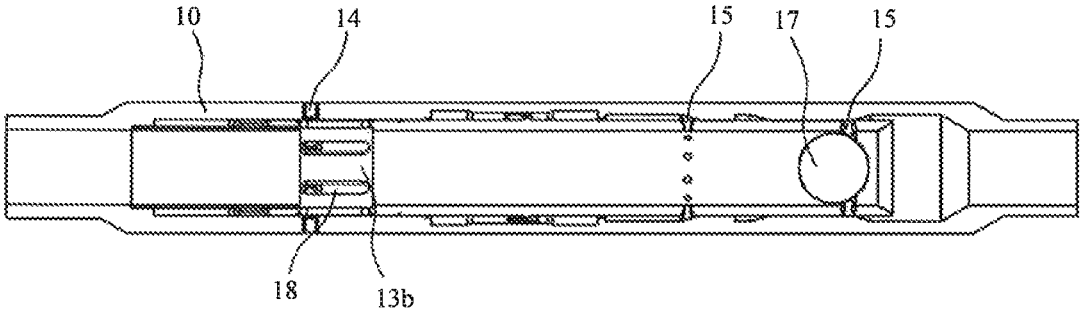
Figure 4E:
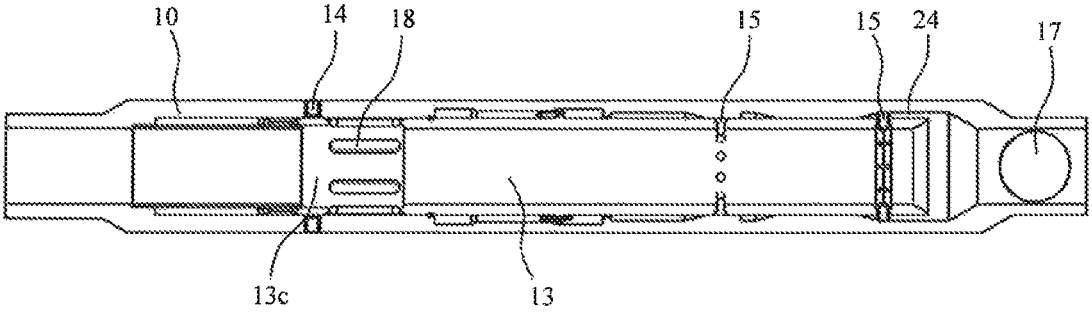
Figure 4F:
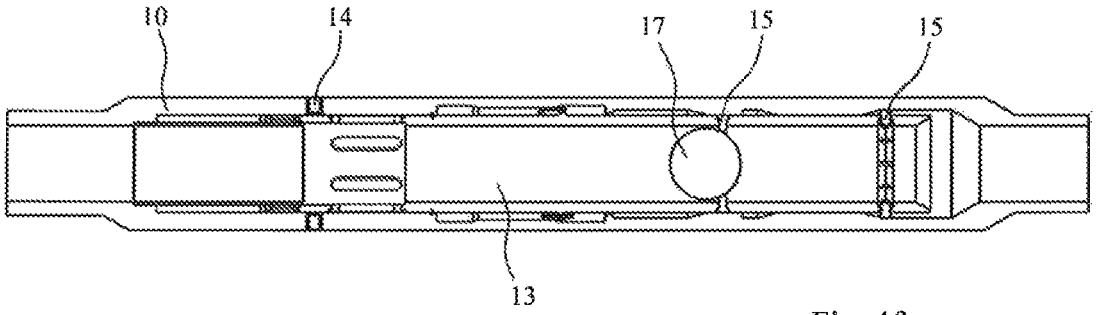
Figure 4H:
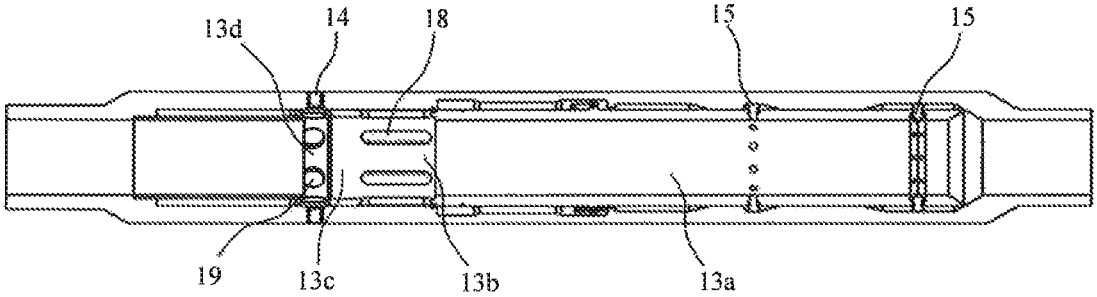

In FIG. 4*a*, the stimulation sleeves 1 are run into the wellbore. The obturator 17 is in FIG. 4*b* landed in the lower obturator seat 15 and pressure is built up. In FIG. 4*c*, the sliding sleeve 13 is shifting to open position and the time delay mechanism 20 is engaged. FIG. 4*d* shows that the sliding sleeve 13 has moved to end of open position, and in FIG. 4*e* the sliding sleeve 13 moves to closed position, the lower obturator seat 15 retracts and the obturator 17 moves to the next stimulation sleeve 1 and repeats the procedure. In FIG. 4*f*, the second obturator 17 has landed in the upper obturator seat 15 and pressure is built to shift the sliding sleeve 13 to open position. In FIG. 4*g*, the sliding sleeve has reached opening position and the dissolvable productions ports 19 are exposed to well fluid. The upper obturator seat retracts and the obturator 17 is released and moves to the next stimulation sleeve 1 and repeats the procedure. In FIG. 4*h*, the dissolvable material in the productions ports 19 are dissolved and production can start from that zone.

In all embodiments, mechanical wireline or coiled tubing intervention can be used to shift the sliding sleeve 13 back to the first closed position, to allow the stimulation operation to be repeated or to re-establish pressure integrity for other operations to take place.

Further, the production ports 19 can be lined with a carbide insert to prevent erosion during proppant pumping.

FIG. 7*a*-7*p* show application of the first embodiment of the invention. As previously explained, a tubing string 36 with a number of stimulation sleeves 1 is run into the wellbore 34 and in position, and completion cement 42 installed. Toe is closed with for instance wiper dart/plug 40, as seen in FIGS. 7*a* and 7*b*. FIG. 7*c* shows a cut away of the lower completion string showing seats 15 of each stimulation sleeve 1. Opening pressure operated toe sleeve 1' to create injection point at toe of wellbore and to inject into toe sleeve 1' is shown in FIGS. 7*d* and 7*e*.

In FIGS. 7*f* and 7*g*, the obturator 17 is pumped down to land on the first obturator seat 15 to isolate completion below. Pressure is applied above the obturator 17 to cause the flow ports 14 of the stimulation sleeve 1 to open and the first stimulation treatment can be performed, see FIG. 7*h*. After the planned time delay, the flow ports 14 of the stimulation sleeve 1 are isolated, as shown in FIG. 7*i*. Continued application of pressure above the obturator 17 causes the obturator seat 15 to retract and releases the obturator 17, as shown in FIG. 7*j*. In FIG. 7*k* the obturator 17 lands in the obturator seat 15 of a second stimulation sleeve 1 and shift the stimulation sleeve 1 to open position.

FIGS. 7*l* and 7*m* show that the sequence continues for the remaining stimulation sleeves 1 in a manner identical to the first sleeve 1. At the end of stimulation, after all stimulation sleeves 1 have been treated, the obturator 17 is left at the bottom of the wellbore 34 and injection into the toe sleeve 1' can continue.

Optionally can a slick line, wireline or coiled tubing shifting tool 44 be conveyed to the bottom of the wellbore 34, and be pulled out to shift the stimulation sleeves 1 to open position, as shown in FIG. 7*n*. After retrieving the shifting tool 44 from the wellbore 34, the stimulation sleeves 1 are in the open position with the obturator seats 15 in extended to their original position, FIG. 7*o*.

FIG. 7*p* indicates that the well can be re-stimulated in nearly the same manner as the initial treatment by dropping another obturator 17. The difference is that all stimulation sleeves 1 begin in open position, and subsequently close after the time delay when the obturator 17 lands in each obturator seat 15. The second obturator 17 is dropped into the well stream in the tubing 36 and the second obturator 17 land on the obturator seat 15 to partially or fully close fluid communication in the through channel 11 of the housing 10. Build up pressure to shift the sliding sleeve 13 axially in the housing 10 to close the flow ports 14 by moving the longitudinal slits 18 in the sliding sleeve 13 out of aligning with the flow ports 14. For controlled travel of the sliding sleeve 13 in the housing 10 to hold the flow ports 14 open a predetermined time, the time delay mechanism 20 is engaged, and thereafter the obturator seat 15 is retracted to release the obturator 17. The procedure is repeated for all stimulations sleeves 1.

Figure 8A:
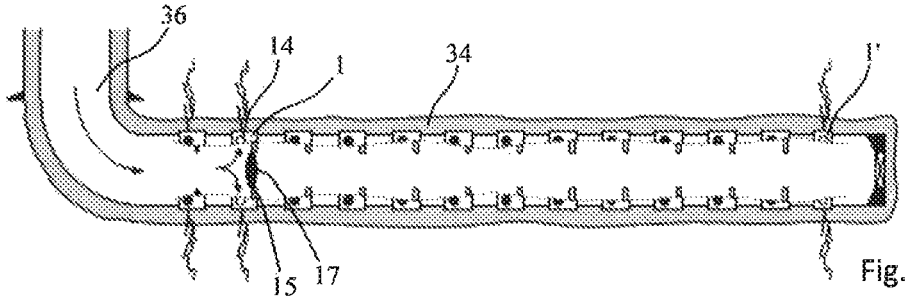
Figure 8B:
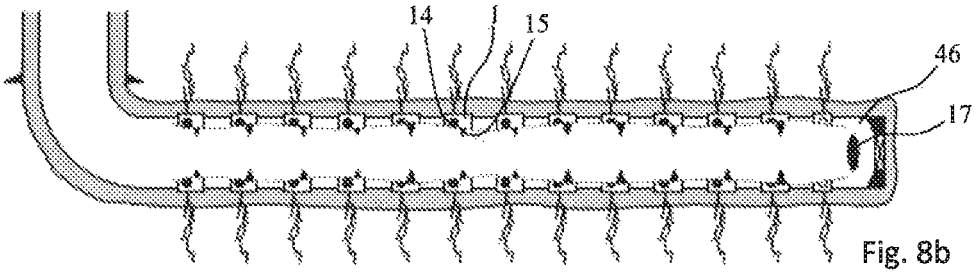

FIG. 8*a*-8*e* show application of the second embodiment of the invention. As mentioned previously, the second embodiment comprises a second obturator seat that is extended when the first obturator seat 15 is retracted, as explained in relation to FIGS. 3 and 4*a*-4*h*, but otherwise is operated similar to the first embodiment. FIG. 8*b* shows that at the end of the final stimulation treatment, every stimulation sleeve 1 is closed and the second obturator seat 15 is extended.

Figure 8C:
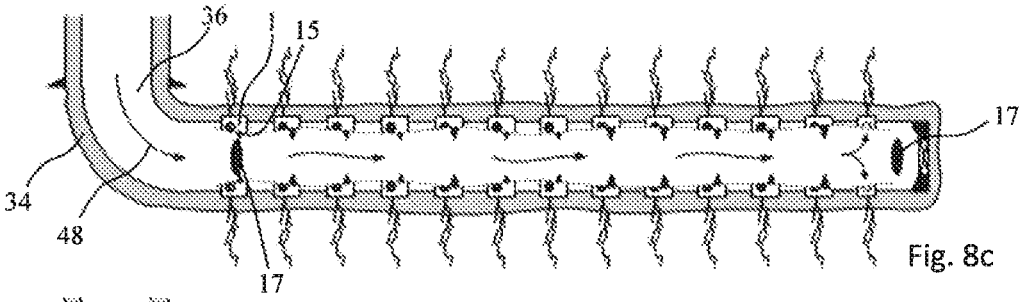
Figure 8D:
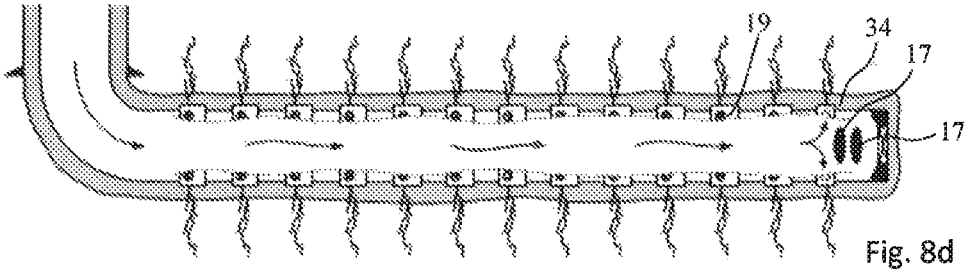
Figure 8E:
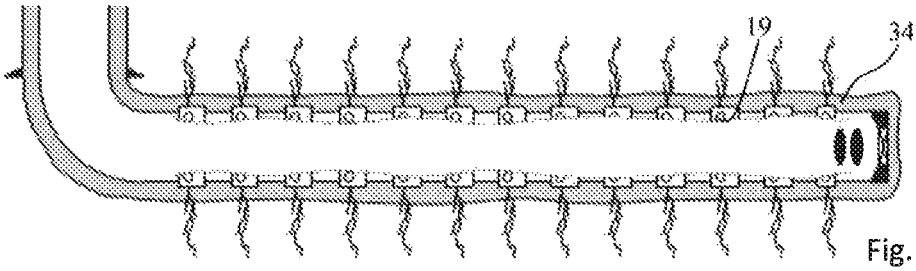

In FIG. 8*c*, the second obturator 17 is pumped into the wellbore 34. The obturator 17 lands in each obturator seat 15 and shifts each stimulation sleeve 1 to a third closed position, whereby a dissolvable or mechanical retaining device prevent pressure or flow communication from tubing to formation, i.e. for instance through the production ports 19. The second obturator seat 15 retracts at the end of this movement and releases the obturator 17. In FIG. 8*d*, the second obturator 17 is pumped to the bottom of the wellbore 34, at which time all of the stimulation sleeves 1 are in the third closed position. An appropriate dissolving fluid can be injected into the well in order to dissolve the retaining devises in the productions ports 19, if they are of dissolvable type, or appropriate pressure activation can be used to remove mechanical retaining devices, as previously explained. As seen in FIG. 8*e* the well will then have all sleeve- or productions ports 19 open to allow production across the reservoir section.

In one possible embodiment, the stimulation sleeve 1 is equipped with one or more tension bolt assemblies 40 (FIG. 9*a*-9*b*), that will prevent the sliding sleeve 13 from moving downhole to the open position. The tension bolt assembly 40 comprises a tension bolt 41 connected to the top of the sliding sleeve 13 equipped with a bolt head 42 placed inside a bolt head cavity 43 in the housing 10. A certain pressure is required to part the tension bolt 41 so the sliding sleeve 13 is free to move. The head 42 of the bolt is placed inside the bolt head cavity 43 where it is free to move a distance which gives the sliding sleeve 13 some room for downhole movement that can help cushioning the impact on the obturator seat 15 when the obturator 17 lands. By using a predefined number of tension bolts 41 with a predefined tension strength the differential pressure across the ball can be calculated by monitoring the surface pressure while pressuring up to part the tension bolt(s) 41.

In one possible embodiment (FIG. 10*a*-10*b*) of the time delay mechanism 20 it comprises a floating piston 50 accommodated in the longitudinal chamber or cavity 21 between the inside surface 10*a* of the housing 10 and the sliding sleeve 13. The P2 side of the cavity 21 is filled with a hydraulic fluid, such as oil. The P1 side of the cavity 21 is in communication with the inside of the sleeve 13, through a number of ports 55. When the sliding sleeve 13 is axially displaced in the housing 10 a shoulder 53 on the sliding sleeve 13 will move towards the floating piston 50 and catch the floating piston starting to move it in the downhole direction. The downhole force on the floating piston 50 will pressurize the fluid in P2. The floating piston 50 can in this embodiment comprise a through bore 54, which is letting fluid escape from P2 to P1 as the sliding sleeve is pushing the piston 50 in the downhole direction inside the cavity 21. The piston 50 with the through bore 54 acts as a flow restrictor, restricting fluid flow from P2 to P1.

A rod 56 can be accommodated partly inside the through bore 54. The rod 56 defines a narrow flow area through the through bore 54. The length of the narrow flow area depends on how deep the rod 56 penetrates the through bore 54. A spring 31 acts with a force on the rod 56, said force acting to push the rod 56 out of the bore 54 in the direction of the P2 side of the cavity 21. A bolt 51 is connected to the uphole facing end of the rod 56, and the bolt is equipped with a head 52 that is situated outside the bore 54 on the P1 side of the floating piston 50. When no other forces than the spring force is acting on the rod 56 the rod 56 will pull on the bolt 51 forcing the head 52 against the P1 side of the piston 50, sealing of the through bore 54. To improve the seal, a gasket can be accommodated between the head 52 and the sealing surface or seat on the P1 side of the piston 50.

When the floating piston 50 is forced in the downhole direction, the pressure in P2 increases. This pressure is acting on a piston area on the rod 56, forcing the rod 56 against the biasing force of the spring 31 and deeper inside the through bore 54. At first this will open up for flow through the piston 50 by removing the seal or restriction created by the head 52 against the floating piston 50, letting fluid escape from P2 to P1 allowing for downhole movement of the floating piston and the sliding sleeve 13. If the downhole force on the piston 50 increases, the pressure in P2 will push the rod 56 further into the through bore 54. This increases the length of the narrow flow area, hence increasing the hydraulic friction for fluid flowing from P2 to P1.

As described above the piston 50 with the spring loaded rod 56 will act as a pressure compensated flow restrictor. This feature allows the time delay to be independent of the pressure difference across the obturator 17. It should be mentioned that the invention is not limited to use one particular type or designs of pressure compensated flow restrictors or time delay mechanisms. The stimulation sleeve can even be used without being pressure compensated.

In a completion string with several stimulation sleeves the time delay mechanism 20 of the individual stimulation sleeves 1 can be set up to give the time delay that is desired for the individual stimulation stage.

The piston together with the spring loaded rod 56, the spring 31 and the bolt 51 will act as a check valve preventing flow from P1 to P2, preventing contaminated well fluid to enter and block the time delay mechanism 20.

One advantage of using a floating piston 50 is avoiding the presence of atmospheric cavities in the stimulation sleeve 1. Since the floating piston 50 can float or in other words move independent of both the sleeve 13 and the housing 10, and the P1 side of the piston is in contact with the wellbore, the piston will move and equalize the pressure on the P2 side of the cavity 21. Due to this thinner walls and a less bulky design is possible.

Another advantage of the floating piston is that it is possible to shift the sleeve back in the uphole direction without being prevented by a piston that is fixed to the sleeve 13 and acts as a check valve.

In one possible embodiment, the obturator seat 15 is donut shaped as seen in FIG. 11*a*-11*c*. When the sleeve 13 is shifted downhole and the donut shaped obturator seat 15 reaches the longitudinal compartment or cavity 23, 24 on the inside surface 10*a*, the obturator seat 15 is allowed to expand radially into the compartment of cavity 23, 24. This will partly split the obturator seat 15 into segments 60, as seen in FIG. 11*c*, allowing the obturator 17 to fall through the obturator seat 15.

FIGS. 12*a* and 12*b* is showing one possible embodiment of the stimulation sleeve 1 equipped with a tension bolt assembly 40 and a time delay mechanism 20 with a pressure compensated flow restrictor. In FIG. 12*a*, the sleeve 13 is in a closed position with the tension bolt 41 intact. In FIG. 12*b* the sleeve 13 is shifted downhole, the tension bolt 41 is parted, the flow port 14 is aligning with the longitudinal slits 18 and a obturator 17 in this case a ball, is placed in the obturator seat 15.

The invention claimed is:

1. Method for well completion in a subterranean wellbore, comprising the steps:

running a tubing string with a number of stimulation sleeves into the wellbore, each stimulation sleeve comprises a housing having a through channel with a first end and a second end, one or more flow ports, and a sliding sleeve disposed axially movable within the housing to open or close said flow ports;

dropping an obturator into a well stream in the tubing and to land the obturator on a first obturator seat to partially or fully close fluid communication in the through channel of the housing;

building up pressure to shift the sliding sleeve axially in the housing to open the flow ports;

engaging a time delay mechanism for controlled travel of the sliding sleeve in the housing to hold the flow ports open a predetermined time, wherein time delay is adjustable for individual sleeves;

closing the flow ports after the sliding sleeve has moved the predetermined time;

the method is characterized by the steps of retracting the obturator seat to release the obturator;

landing a second obturator in a second seat, said second obturator seat being located uphole of the first obturator seat, and to build up pressure to shift the sliding sleeve axially in the housing to re-open the flow ports by aligning production ports in the sliding sleeve with the flow ports; and retracting the second obturator seat to release the second obturator after the production ports in the sliding sleeve are aligned with the flow ports.

2. Method according to claim 1, wherein the time delay mechanism is accommodated in a hydraulic chamber on the inner surface of the housing, and the method comprises the following steps to set the time delay:

regulating flow in the hydraulic chamber by restricting hydraulic fluid flow from one side of the chamber to the other side of the chamber.

3. Method according to claim 1, wherein the flow ports are opened by aligning longitudinal slits in the sliding sleeve with the flow ports, and the flow ports are closed by allowing one or more longitudinal slots in the sliding sleeve to move out of alignment with the flow ports.

4. Method according to claim 1, wherein the production ports in the sliding sleeve are filled with a dissolvable material that dissolves when exposed to well fluids.

5. Method according to claim 1, wherein the production ports in the sliding sleeve are mechanically opened, by applying pressure cycles on one or more dual action plugs.

6. Method according to claim 1, wherein a shifting tool is conveyed into the wellbore to shift the stimulation sleeves to open position after the stimulation is completed.

7. Method according to claim 6, wherein a second obturator is dropped into the well stream in the tubing string and to land the second obturator on the obturator seat to partially or fully close fluid communication in the through channel of the housing, building up pressure to shift the sliding sleeve axially in the housing to close the flow ports, engaging the time delay mechanism for controlled travel of the sliding sleeve in the housing to hold the flow ports open a predetermined time, and retracting the obturator seat to release the obturator.

8. Method according to claim 1, wherein the obturator after being released from the obturator seat of the stimulation sleeve travels with gravity or fluid flow to the next stimulation sleeve to repeat the process from the previous stimulation sleeve.

9. Method according to claim 1, wherein a floating piston with a spring loaded rod as part of the time delay mechanism adds pressure compensating abilities to the time delay mechanism, by letting the spring loaded rod's depth of penetration inside a through bore in the floating piston, being determined by the differential pressure across the floating piston, hence not letting increased differential pressure across the obturator affect the flow of fluid across the floating piston.

10. Method according to claim 9, wherein the time delay can be adjusted by reducing or increasing a narrow flow area past the rod through the through bore.

11. Method according to claim 9, wherein the time delay can be adjusted by using fluid with higher or lower viscosity in the hydraulic chamber.

12. Method according claim 1, wherein one or more tension bolts that prevents the sliding sleeve from shifting to the open position has a predefined tension strength, and by monitoring a surface pump pressure while pressuring up to part the tension bolt one can calculate the differential pressure across the obturator in the obturator seat.

13. A stimulation sleeve for well completion in a subterranean wellbore, comprising:

a housing having a through channel with a first and a second end, and one or more flow ports, and a sliding sleeve disposed axially movable within the housing to open or close said flow ports, wherein said sliding sleeve is equipped with at least a first obturator seat for receipt of a obturator to partially or fully close fluid communication in the through channel of the housing and wherein the sliding sleeve comprises a first closed part for closing the flow ports and a second partially open part equipped with longitudinal slits for alignment with the flow ports to open the flow ports, characterized by an adjustable time delay mechanism to allow the sliding sleeve to axially travel in the housing at a predetermined speed to open or close said flow ports.

14. Stimulation sleeve according to claim 13, wherein the sliding sleeve comprises a third closed part for closing the flow ports.

15. Stimulation sleeve according to claim 13, wherein the sliding sleeve comprises a fourth partially open part equipped with production ports for alignment with the flow ports to open the flow ports.

16. Stimulation sleeve according to claim 15, wherein the production ports in the sliding sleeve are filled with a dissolvable material that dissolves when exposed to well fluids.

17. Stimulation sleeve according to claim 15, wherein the production ports in the sliding sleeve comprises one or more dual action plugs, which are opened by applying pressure cycles.

18. Stimulation sleeve according to claim 13, wherein the obturator seat comprises a plurality of radially placed and retractable plungers being activated by the movement of the sliding sleeve.

19. Stimulation sleeve according to claim 18, wherein at least one gasket is placed upstream of said plungers.

20. Stimulation sleeve according to claim 13, wherein the sliding sleeve comprises a second obturator seat for receipt of a second obturator, said second obturator seat being located upstream of the first obturator seat, in order to build up pressure and to shift the sliding sleeve axially in the housing to open the flow ports by aligning the production ports in the sliding sleeve with the flow ports.

21. Stimulation sleeve according to claim 13, wherein the time delay mechanism is accommodated in a hydraulic chamber on the inner surface of the housing and comprises a flow restrictor.

22. Stimulation sleeve according to claim 21, wherein the time delay mechanism comprises a metering device with a piston surface area and longitudinal holes, each of which contains a hydraulic metering orifice which separates two sides of the piston.

23. Stimulation sleeve according to claim 21, wherein the time delay mechanism comprises a timing valve with a porous filter media rod that allows hydraulic fluid to pass from one side of the chamber to the other side of the chamber.

24. Stimulation sleeve according to claim 23, wherein the porous filter media rod is connected to a spring for regulation of how much of the porous media rod that is exposed to the hydraulic fluid.

25. Stimulation sleeve according to claim 21, wherein the time delay mechanism comprises a floating piston with a through bore that allows hydraulic fluid to pass from one side of the chamber to the other side of the chamber.

26. Stimulation sleeve according to claim 25, wherein the floating piston comprises a spring loaded rod accommodated in the through bore, defining a narrow flow area past the rod through the through bore.

27. Stimulation sleeve according to claim 26, wherein the differential pressure across the floating piston regulates the penetration depth of the spring loaded rod inside the through bore.

28. Stimulation sleeve according to claim 13, wherein the sliding sleeve is restricted from moving by one or more tension bolts.

* * * * *